United States Patent [19]

Fourneaux et al.

[11] Patent Number: 5,016,676

[45] Date of Patent: May 21, 1991

[54] SYSTEM FOR DETECTING AND CORRECTING WEFT MISFEEDS

[75] Inventors: Roger Fourneaux, La Tour Du Pin; Gilles Grandvallet, Bourgoin Jallieu, both of France

[73] Assignee: S. A. Saurer Diederichs, Bourgoin Jallieu, France

[21] Appl. No.: 477,359

[22] Filed: Feb. 7, 1990

[30] Foreign Application Priority Data

Feb. 7, 1989 [FR] France ..... 89 01918

[51] Int. Cl.[5] ..... D03D 47/34; D03D 51/34

[52] U.S. Cl. ..... 139/116.2; 139/370.2; 139/450; 139/453

[58] Field of Search ..... 139/450, 370.2, 116.2, 139/452, 453, 435.1

[56] References Cited

U.S. PATENT DOCUMENTS 4,890,649 1/1990 Takahashi ..... 139/450 X
4,924,917 5/1990 Shaw ..... 139/452
4,926,911 5/1990 Shaw ..... 139/450

*Primary Examiner*—Andrew M. Falik
*Attorney, Agent, or Firm*—Herbert Dubno; Andrew Wilford

[57] ABSTRACT

In a loom a weft filament is fed from a supply and inserted in a weft direction through a warp so as to project from a downstream edge of the warp and the presence of the filament is detected by a sensor at the downstream edge. If no presence is detected, a deweaving device is operated that in a deweaving step strips the filament from the warp and ejects it therefrom past the sensor. A controller is connected to the sensor and loom for shutting down the loom when the sensor detects that no filament is ejected by the deweaver during and immediately after the deweaving step, shutting down the loom when the sensor detects a filament immediately after the deweaving step, and restarting the loom when the sensor detects a filament during but not immediately after the deweaving step.

4 Claims, 2 Drawing Sheets

| SITUATION | WARP | $T_1$ | $T_2$ | ACTION |
|---|---|---|---|---|
| A | | 1 | 0 | RESTART |
| B | | 1 | 1 | STOP |
| C | | 0 | 0 | STOP |
| D | X | 0 | 0 | STOP |
| E | X | 0 | 0 | STOP |

FIG.2

| SITUATION | WARP | $T_1$ | $T_2$ | ACTION |
|---|---|---|---|---|
| F | | 1 | 0 | STOP |
| G | | 1 | 1 | STOP |
| H | X | 0 | 0 | SWITCH TO OTHER WEFT FEED |

FIG.3

SYSTEM FOR DETECTING AND CORRECTING WEFT MISFEEDS

FIELD OF THE INVENTION

The present invention relates to an automatic loom. More particularly this invention concerns a method of and apparatus for detecting and correcting misfeeds of a weft filament in such a loom.

BACKGROUND OF THE INVENTION

It is known to provide a loom with two separate weftfilament feeds so that, if one of the feeds jams or runs out, the other can take over. Thus the loom can keep running while the problem with the nonoperational feed is cured.

In European patent 195,469 issued 29 March 1989 (based on Belgian patent application 60,647 filed 19 March 1985 by J. Waelhens and assigned to Weefautomaten Picanol) such a loom is described where a plurality of sensors are provided along the path of the weft filament in each of the two separate weft feed units. These sensors monitor the conditions of the weft filaments and, on detection of a defect in the currently operating unit, switch the system over to the other feed unit.

Such a system thus requires two fairly elaborate sets of sensors in addition to the normally provided sensors. This is in addition to the normally provided system that detects if the weft filament has been properly inserted in the warp. Furthermore this arrangement cannot be adapted to a shuttleless loom in which the weft filament is shot by compressed gas across the warp because it is much more difficult to provide an air-insertion machine with a plurality of inserters than it is to provide multiple inserters on a standard mechanical system.

OBJECTS OF THE INVENTION

It is therefore an object of the present invention to provide an improved weft-defect detection system for a shuttleless loom.

Another object is the provision of such an improved weft-defect detection system for a shuttleless loom which overcomes the above-given disadvantages, that is which is relatively simple yet which surely switches over to another weft supply in the event of weft failure.

SUMMARY OF THE INVENTION

Thus the instant invention is an improvement in a loom wherein a weft filament is fed from a supply and inserted in a weft direction through a warp so as to project from a downstream edge of the warp and the presence of the filament is detected by a sensor at the downstream edge and, if no presence is detected, a deweaving device is operated that in a deweaving step strips the filament from the warp and ejects it therefrom past the sensor. According to this invention a controller is connected to the sensor and loom for shutting down the loom when the sensor detects that no filament is ejected by the deweaver during and immediately after the deweaving step, shutting down the loom when the sensor detects a filament immediately after the deweaving step, and restarting the loom when the sensor detects a filament during but not immediately after the deweaving step.

Thus with the system of this invention the already provided weft-filament detector is used to determine if the deweaving device has actually worked. If the weft filament is not ejected, because (1) it is snagged in the warp, (2) it has not been cut at the upstream edge, or (3) it was never fed into the warp, the loom is shut down. On the other hand if the deweaving device operates and the sensor detects that a piece of filament is ejected, this is taken to indicate that the defect is not serious and has been cured, so that the loom can be restarted.

According to another system of this invention the loom is provided with two separate supplies of weft filament. In this case the controller is connected to both supplies for shutting down the loom when the sensor detects a filament during or immediately after the deweaving step and switching the loom to the other supply when the sensor detects no filament during or after the deweaving step. Thus if the loom is restarted because during the first reweaving step a piece of filament was ejected, but during a second reweaving step no filament is found this indicates that the original defect was caused by the supply jamming or running out, so that the system of this invention automatically switches to the other supply and cures the defect. If, on the contrary, a defect is detected during the loom cycle following a successful reweaving step and on the second reweaving another piece is detected, this means that there is some serious problem and the loom is shut down.

DESCRIPTION OF THE DRAWING

The above and other objects, features, and advantages will become more readily apparent from the following, reference being made to the accompanying drawing in which:

FIGS. 2 and 3 are tables illustrating operation of the loom in accordance with the invention.

SPECIFIC DESCRIPTION

Figure 1:
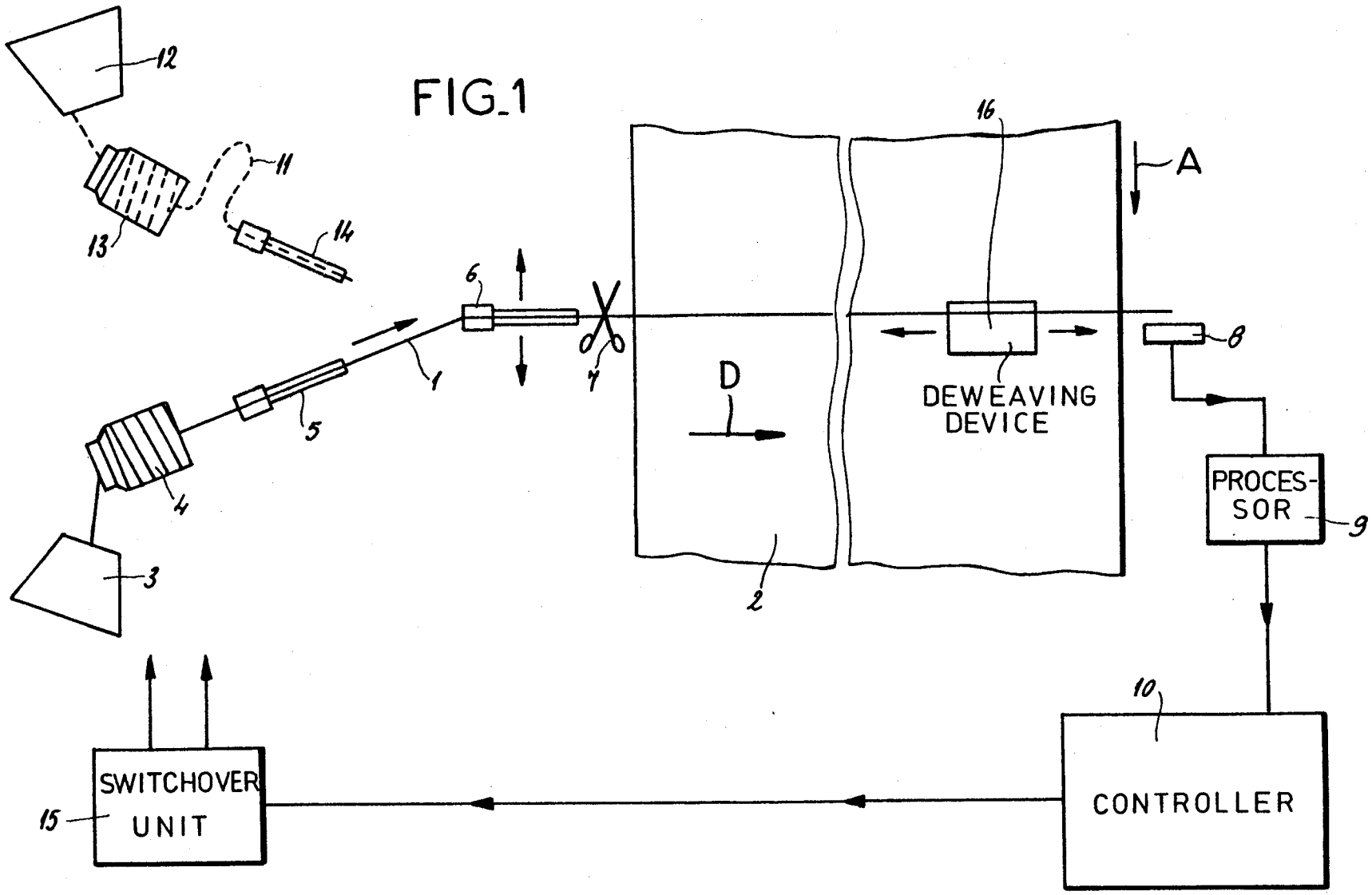
FIG. 1 is a largely diagrammatic top view of a loom according to this invention.

As seen in FIG. 1 a primary weft filament 1, which can be a yarn or thread, is inserted in a crosswise weft direction D through a warp that is shown schematically at 2 and that normally moves perpendicular to the direction D as indicated by arrow A. The thread 1 is pulled from a supply spool 3 and passes through a device 4 that measures out a predetermined length. Then it passes through an upstream fixed nozzle 5 that expels it pneumatically into the upstream (relative to direction D) end of a movable nozzle 6 that is attached to the unillustrated reed of the loom. The nozzle 6 like the nozzle 5 is supplied with compressed air to move the filament 1 so that no shuttle is needed.

The filament 1 is blown by the nozzle through the shed of the warp 2 and is beaten thereinto. A cutting device shown schematically at 7 severs the filament 1 upstream of the warp 2 once the it is beaten in. On each pick the downstream end of the filament 1 exits from the warp 2 at the downstream edge thereof where its presence can be detected by a sensor 8, typically of photoeye type such as described in U.S. Pat. No. 4,085,777. As a rule if the sensor 8 detects the leading end of the filament or weft 1, it can be presumed that the filament 1 has been properly inserted into the warp 2 and the weaving will proceed normally.

As described in commonly owned patent application Ser. No. 357,560 filed 25 May 1989 and in the literature cited therein, when no filament is detected by the sensor 8 an automatic unweaving apparatus 16 is set in operation. This apparatus comprises at least one stripping nozzle directed generally upstream against the warp direction A and connected to a supply that feeds compressed gas to the nozzle so the gas is expelled therefrom as a jet directed generally upstream against the warp direction A over the defective pick to dislodge same from the warp 2. The defective pick is then withdrawn in the weft direction D from the shed after it is dislodged from the warp 2 by the nozzle. As this defective pick is withdrawn its passage will be detected by the sensor 8. Such arrangements are also described in Belgian patent applications 8,800,299, and 8,800,300 (U.S. equivalents U.S. Pat. Nos. 4,924,917 and 4,924,911, respectively). These systems have a control unit which deactivates the thread-preparation mechanism in which a thread break has occurred and transfers the task of the deactivated thread-preparation mechanism to a second thread-preparation mechanism. Further such mispick-removing and switchover 5 devices are described in European patent application 309,013 of D. Lewyllie based on a Belgian priority of 26 August 1987 and in U.S. Pat. Nos. 4,573,499, 4,716,941, and 4,730,643.

According to this invention the output of the sensor 8 is processed by a unit 9 and fed to a controller 10. In addition the system is provided with a second feed unit for a second filament 11 comprising a supply 12, feeder 13, and fixed nozzle 14 substantially identical to the supply 3, feeder 4, and nozzle 5. A switchover unit 15 operated by the controller 10 can select which of the filaments 1 or 11 will be fed to the warp 2.

FIG. 2 shows five different situations A through E that can happen in the event of a weft defect as determined when the sensor 8 does not detect a filament at the downstream (relative to direction D) edge of the warp 2 after picking. The possible defects are illustrated schematically in the second column. The third column shows the outputs of the processor 9 during a time T1 during a first deweaving carried out by the apparatus 16, a 1 indicating that a filament is detected by the sensor 8 and a 0 indicating that none is detected. The fourth column shows the processor outputs at a time T2 after the first deweaving, and the fifth column shows the action taken by the controller 10, either restarting the loom or stopping it.

In situation A the weft filament has simply not reached across the warp, but the deweaving operation is effective to free it as indicated by the 1 in time Tl and after the deweaving operation as indicated by the 0 in time T2 there is no filament hanging from the warp. In this case the loom is simply restarted as the defect was apparently short lived or the supply ran out during the pick.

With situation B the sensor 8 is detecting a filament at the downstream warp edge both during and after the deweaving operation. This indicates that the misfed weft has not been completely removed. The controller 10 shuts down the loom.

In situations C, D, and E the filament is not detected either during or after the deweaving operation. This can mean that the cutter 7 did not work so that the deweaving could not free the piece as seen in situation C, or that the piece is stuck in the warp as seen at situation D. It can also mean that there has been a supply failure in that no weft was even fed into the warp as indicated at situation E. Thus the controller shuts down the loom.

FIG. 3, which uses the same format and notation as FIG. 2, indicates operation of the machine for the pick following the pick cleared in situation A described above, where the defective pick is cleared and the loom restarted. The situations of FIG. 3 occur when the sensor 8 does not detect a filament at the downstream edge of the warp 2 in the pick immediately following restarting of the machine after deweaving a defective pick.

Situation F of FIG. 3 corresponds to repeat of situation A, with the loom being stopped when the sensor 8 detects a filament during but not after the second deweaving cycle. In situation G a filament is detected both during and after the second deweaving, indicating that the filament is not being cut properly or is too long, so that once again the loom is stopped.

In situation H no filament is detected during time T1 when the deweaving is taking place, indicating that no piece was found in the warp, nor afterward during time T2. This is a clear indication that the supply has run out so that the controller 10 simply has the switchover unit 15 change to the other weft-filament supply and the loom is restarted.

Thus the system of this invention can be applied to a single-supply loom as shown in FIG. 2 to automatically restart the loom in the event of a minor weft misfeed and to automatically stop it when anything else happens. When the loom is stopped a signal is ordinarily illuminated so that the machine operator can tend to the problem. The single-supply loom can also be equipped with an automatic tying device that is triggered by the system of this invention to repair the broken filament. In any case the system of this invention is capable of using the filament-breakage detector normally provided on a loom not only to detect breakage at the downstream edge of the warp, but also to detect such breakage in the upstream feed system.

In addition the system of this invention can be used in a multiple-supply system, by switching mode when, after clearing a bad pick and restarting, a second bad pick is detected. In this case the machine is capable of determining whether the problem is an upstream feed problem which can be cured by switching to another supply. Of course in this case a signal is sent to inform the operator to check the first supply and, thereafter the system reverts to the response of FIG. 2.

We claim:

1. In a loom wherein:

a weft filament is fed from a supply and inserted in a weft direction through a warp so as to project from a downstream edge of the warp;

a sensor is provided at the downstream edge for detecting the presence of a weft filament thereat and generating an output corresponding thereto;

a deweaving device operates in a deweaving step when the sensor detects no weft filament at the downstream edge after the weft is inserted by stripping a filament from the warp and ejecting it from the warp past the sensor; a control system comprising:

control means connected to the sensor and loom for shutting down the loom when the sensor detects that no filament is ejected by the deweaving device during and immediately after the deweaving step, shutting down the loom when the sensor detects a filament immediately after the deweaving step, and restarting the loom when the sensor detects a filament during but not immediately after the deweaving step.

2. The control system defined in claim 1 wherein the loom is provided with two separate supplies of weft filament, the control means further being connected to both supplies for:

shutting down the loom when the sensor detects a filament during or immediately after the deweaving step; and switching the loom to the other supply when the sensor detects no filament during or after the deweaving step.

3. In a method of weaving with a loom wherein:

a weft filament is fed from a supply and inserted in a weft direction through a warp so as to project from a downstream edge of the warp;

the presence of the filament is detected by a sensor at the downstream edge and, if no presence is detected, a deweaving device is operated that in a deweaving step strips the filament from the warp and ejects it therefrom past the sensor, a control method comprising:

shutting down the loom when the sensor detects that no filament is ejected by the device during and immediately after the deweaving step;

shutting down the loom when the sensor detects a filament immediately after the deweaving step; and restarting the loom when the sensor detects a filament during but not immediately after the deweaving step.

4. The method defined in claim 3 wherein the loom is provided with two separate supplies of weft filament, the method further comprising the step after restarting the loom of:

shutting down the loom when the sensor detects a filament during or immediately after the deweaving step; and switching the loom to the other supply when the sensor detects no filament during or after the deweaving step.

* * * * *